US005365861A

United States Patent [19]

Gutgsell

[11] Patent Number: 5,365,861

[45] Date of Patent: Nov. 22, 1994

[54] LATCH MECHANISM FOR FOLDING TABLE LEG

[75] Inventor: David R. Gutgsell, Jasper, Ind.

[73] Assignee: Ditto Sales, Inc., Jasper, Ind.

[21] Appl. No.: 820,511

[22] Filed: Jan. 14, 1992

[51] Int. Cl.[5] ..... A47B 3/00

[52] U.S. Cl. ..... 108/132; 292/209

[58] Field of Search ..... 108/131, 132, 133; 292/80, 87, 263, 303; 248/439, 188.6; 403/329

[56] References Cited

U.S. PATENT DOCUMENTS

| | | | |
|---|---|---|---|
| Re. 13,013 | 8/1909 | Keck | 108/133 |
| 305,385 | 9/1884 | Gunsel . | |
| 314,918 | 3/1885 | Curry | 292/209 X |
| 761,963 | 6/1904 | Murray . | |
| 911,447 | 2/1909 | Roessler | 403/329 |
| 2,266,643 | 12/1941 | Kruse | 403/329 |
| 2,455,765 | 12/1948 | Harvey | 403/329 X |
| 2,621,357 | 12/1952 | Stuman | 292/303 |
| 2,669,494 | 2/1954 | Lenz, Sr. | 108/133 |
| 3,298,478 | 1/1967 | Soprani | 108/132 |
| 3,554,591 | 1/1971 | Rowe | 292/17 |
| 3,628,471 | 12/1971 | Burr | 108/132 |
| 4,055,124 | 10/1977 | Weagle | 108/132 |
| 4,786,119 | 11/1988 | Smuda | 403/329 X |
| 4,938,513 | 7/1990 | Gunderson | 292/80 |

*Primary Examiner*—Michael J. Milano
*Attorney, Agent, or Firm*—Woodard, Emhardt, Naughton, Moriarty & McNett

[57] ABSTRACT

A latch mechanism for a folding table in which the table includes stowable legs, a modesty panel and a horizontal table top supported by the legs. The latch mechanism latches the legs of the table into an upright position. The latch mechanism includes a pin rigidly fastened to a leg of the table such that the tip of the pin projects away from the leg. A cantilever spring plate defining a bore sized to receive at least a portion of the tip of the pin therethrough is attached to the modesty panel of the table. The bore of the spring plate aligns with the pin when the table is opened to its upright position. The cantilever spring plate includes a bend which resiliently biases the spring plate away from the modesty panel. The pin is freed from the bore allowing the legs of the table to move to their stowed position when the spring plate is moved toward the modesty panel against the biasing action of the cantilever spring plate.

17 Claims, 3 Drawing Sheets

LATCH MECHANISM FOR FOLDING TABLE LEG

BACKGROUND OF THE INVENTION

This invention relates to a latch mechanism for latching a folding table leg into its extended upright position. In particular, this invention relates to a latch mechanism for latching the legs relative to a vertical modesty panel of a folding table.

Often tables include folding legs that pivot away from their upright position or are otherwise movable to a stowed position to enable the table to be stored away in a compact location when not in use. In order to make such a table more stable and rigid in its upright position, a latch or catch mechanism is included to hold the legs upright and prevent the legs from pivoting to their stowed position. One such table includes stowable legs that pivot into place adjacent a vertical modesty panel. A modesty panel is simply a vertically oriented panel disposed immediately below the surface of the table such that the panel conceals the lower body of a person sitting at the table from an observer located on the opposite side of the table. Often the modesty panel has the ability to pivot or otherwise move to a stowed position independently of the legs of the table. Folding tables that includes modesty panels can be made exceptionally stable and rigid when a latch or catch mechanism is provided to latch the table legs to the modesty panel when both are deployed to their respective upright positions.

Although there are numerous folding table latching devices known in the art, many are difficult to use, some do not provide adequate rigidity, others fail to provide adequate lateral support, and the performance of most is subject to deterioration over time and repeated use. What is needed is a simple, robust and easily manufactured latch mechanism that is suitable for use on folding tables, especially those which include a modesty panel.

SUMMARY OF THE INVENTION

A latch mechanism is provided for a folding table that includes stowable legs, a modesty panel and a horizontal table top supported by the legs. The latch mechanism is used for latching the legs of the table into an upright position. The latch mechanism according to one embodiment of the present invention comprises a pin and a spring plate. The pin includes a base rigidly fastened to one of the table legs and a tip which projects away from the leg. The spring plate is attached to the modesty panel and includes a bore sized to receive at least a portion of the tip of the pin therethrough. Also included is means for resiliently biasing the spring plate away from the modesty panel. The spring plate is attached to the modesty panel such that the pin aligns with the bore when the table is opened to its upright position. The pin is freed from the bore allowing the legs of the table to move to their stowed position when the spring plate is moved toward the modesty panel against the action of the biasing means.

A folding table according to another embodiment of the present invention comprises a pair of leg assemblies. Each leg assembly includes two legs connected to each other and is movable from a stowed position to an upright position. The table also includes a horizontal table top which is supportable by the pair of leg assemblies when the leg assemblies are moved to their upright positions. A vertical modesty panel is connected to the underside of the table top adjacent the leg assemblies A pin is rigidly fastened to and projects away from one leg of each leg assembly. A spring plate for each pin is attached to the modesty panel. Each spring plate defines a bore sized to receive at least a portion of one pin. Also included is means for resiliently biasing each spring plate away from the modesty panel. Each of the two pins aligns with the bore of one of the two spring plates when the leg assemblies are moved to their upright position.

One object of the present invention is to provide an improved latching mechanism for folding tables and the like.

Another object of the present invention is to provide a latch mechanism that is easy to use.

Another object of the present invention is to provide a latch mechanism which improves the stability of a folding table.

Still another object of the present invention is to provide means for maintaining the stability of a folding table.

Other objects and advantages of the present invention will be clear from the foregoing description.

DESCRIPTION OF THE PREFERRED EMBODIMENT

Figure 1:
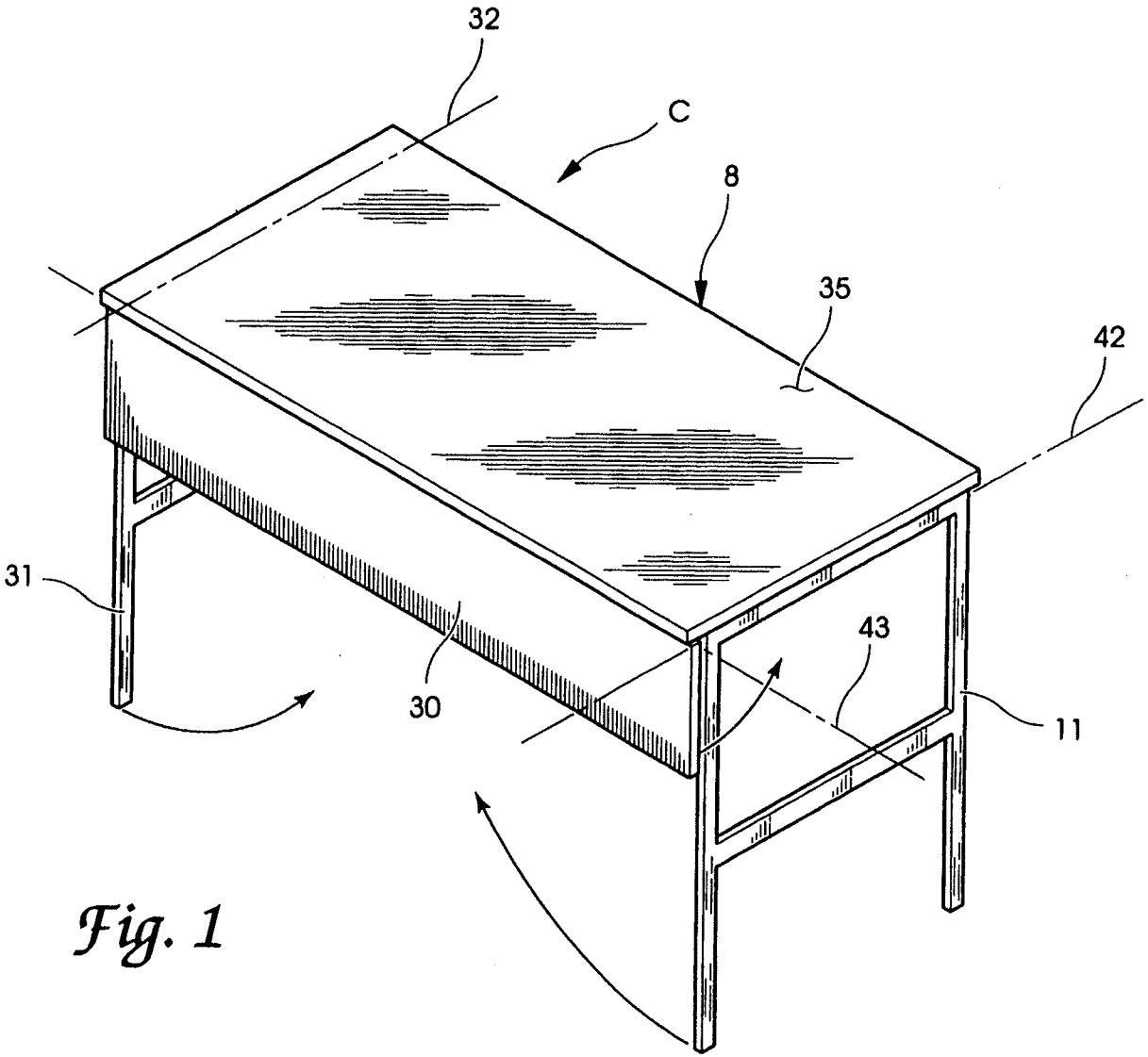
FIG. 1 is an isometric view of a folding table according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, FIG. 1 shows a folding table 8 having the preferred structure for utilizing the latch mechanism of the present invention. Table 8 includes a horizontal table top 35, vertical modesty panel 30 and a pair of leg assemblies 11 and 31. Each leg assembly includes two legs connected together by a crossbar. Table 8 is shown in its upright position supported by the leg assemblies but is capable of assuming a stowed configuration in which the leg assemblies and modesty panel are folded to a position adjacent the underside of horizontal top 35. The table is held in its upright position by a pair of latch mechanisms (not shown in this view) which latch leg assemblies 11 and 31 to modesty panel 30. The table is put into its stowed configuration by releasing the latching mechanisms, folding the leg assemblies about their respective axes 32 and 42 to their stowed positions adjacent the underside of table top 35, and then folding modesty panel 30 about axis 43 to a position parallel to table top 35.

Figure 2:
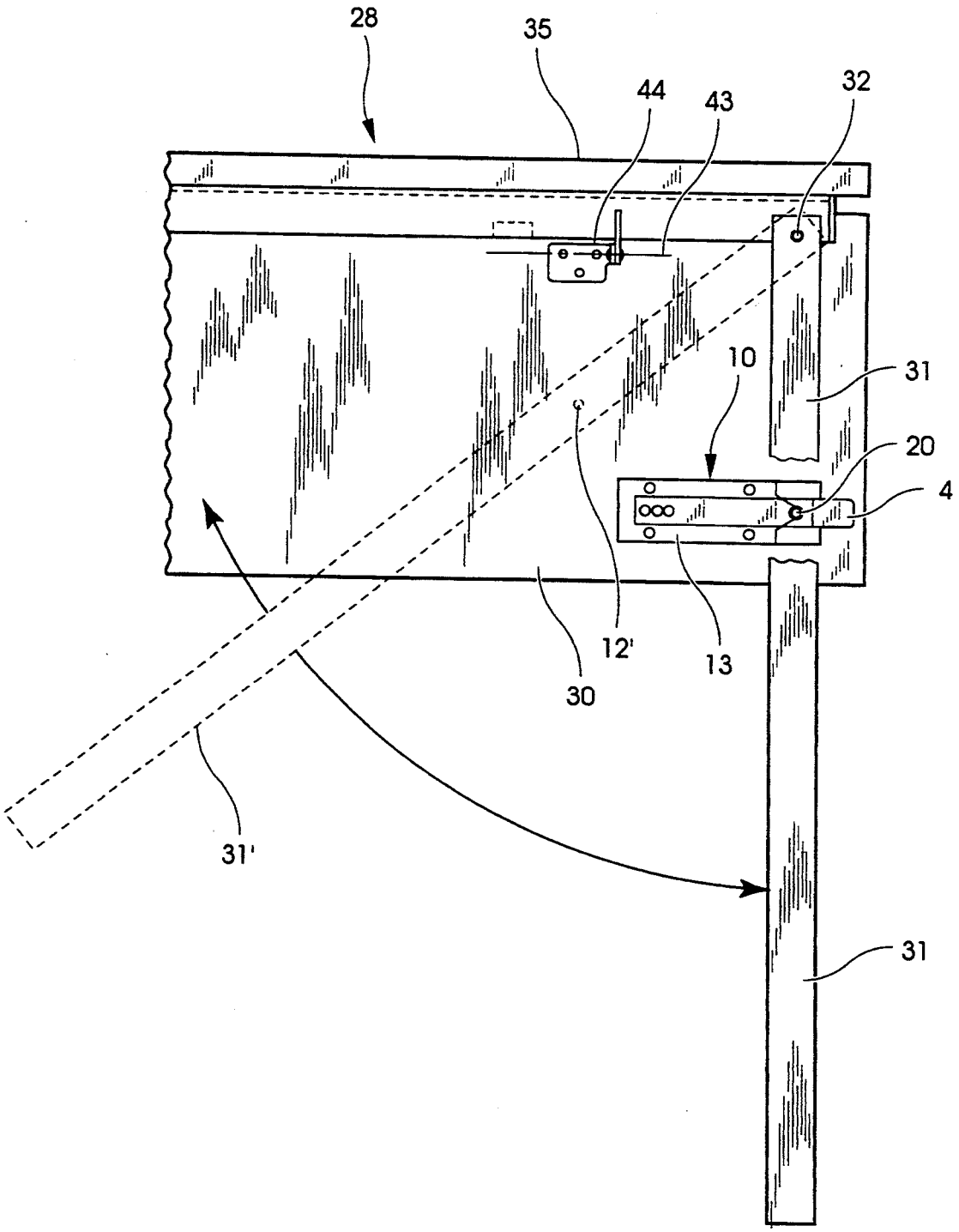
FIG. 2 is a view of the folding table of FIG. 1 taken along view line C of FIG. 1.

FIG. 2 shows a partial view of a folding table of FIG. 1 in which a portion of leg assembly 31 is cut away to reveal latching mechanism 10 according to the present invention. Latch mechanism 10 is latched to modesty panel 30 adjacent leg assembly 31 when the table is opened to its upright position. Modesty panel 30 is attached to the underside table top 35 by a pair of hinges 44 (FIG. 2), only one of which is shown. Leg assembly 31 is likewise attached to the underside of table top 35 by hinges which are known in the art such that it is able to pivot about axis 32 to and from a stowed position. The folding table is latched into its upright position when leg assembly 31 is pivoted to the point where pin 12' (shown only in phantom) aligns with and is received by bore 20 of latch mechanism 10.

Figure 3:
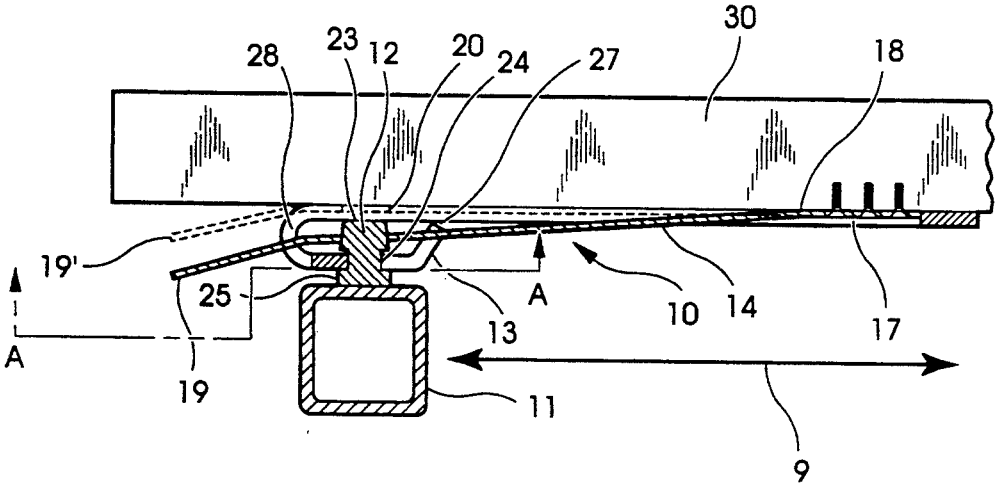
FIG. 3 is a top cross-sectional view of a latching mechanism according to the present invention attached to a folding table, the view being taken along section B—B of FIG. 4.
Figure 4:
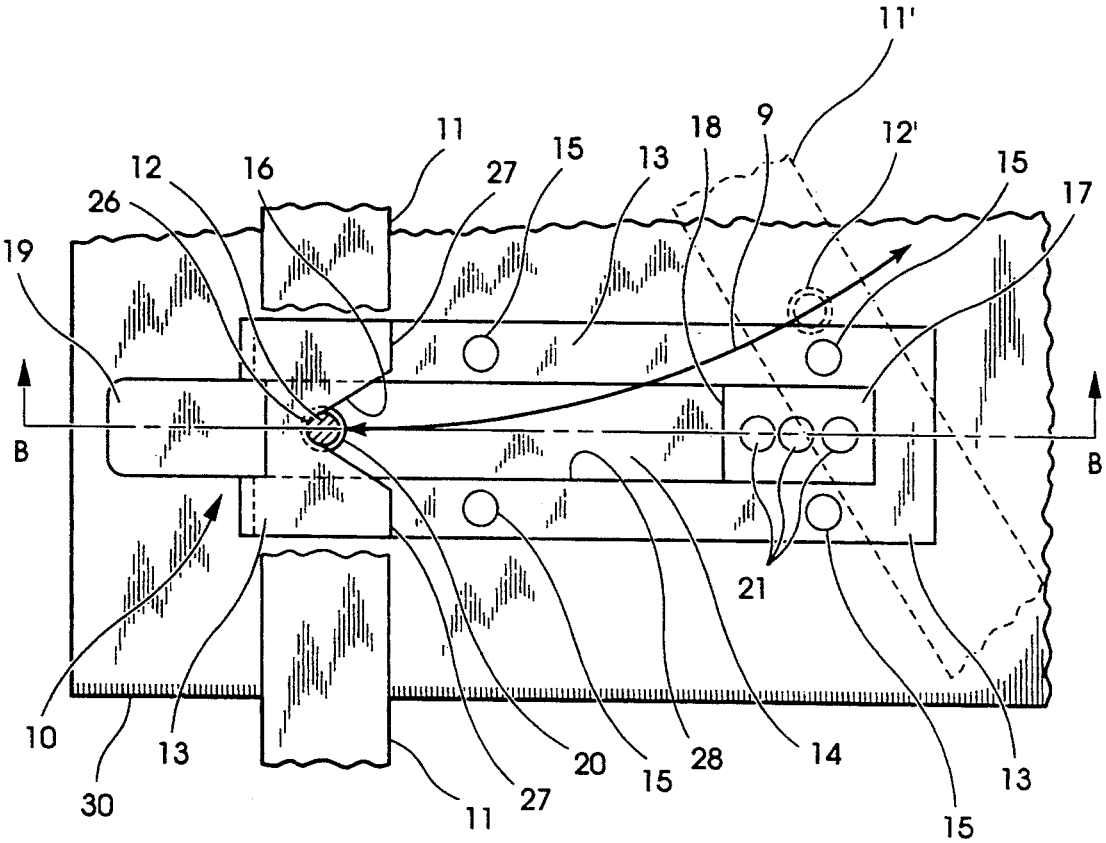
FIG. 4 is partial cutaway front view of the folding table and latch mechanism shown in FIG. 3.

FIGS. 3 and 4 show enlarged views of a latch mechanism according to the present invention attached to the opposite side of table 8 as that shown in FIG. 2. Latch mechanism 10 includes a pin 12, a bracket 13 and a spring plate 14. Pin 12, which is preferably machined from hardened tool steel, includes a base 25 which is attached to leg 11, an annular groove 24 and a tip 23. Spring plate 14 includes a first end 17 which is attached by screws 21 to modesty panel 30 so that plate 14 is cantilevered. A slight bend 18 on the order of 9° to 11° biases the remainder of plate 14 away from modesty panel 30. It is understood that other means could be employed for resiliently biasing spring plate 14 away from modesty panel 30. Spring plate 14 also includes a bore 20 which is sized to receive the tip 23 of pin 12. Bore 20 in spring plate 14 is shown round but could also be made slightly oblong in order to increase the amount of contact between tip 23 of pin 12 and the annular edge of bore 20. The cantilevered length of spring plate 14, i.e. the distance between bend 18 and bore 20, results in nearly horizontal contact of plate 14 to pin 12, thus permitting the use of a round bore 20 without any loss in performance. Spring plate 14 in one specific embodiment is made from C1095 spring steel with a thickness of about 0.062 inch.

Leg assembly 11 is latched to modesty panel 30 when pin 12 is aligned with and received within bore 20 of spring plate 14. As leg assembly 11 approaches the latch position, tip 23 of pin 12 scrapes against spring plate 14 until pin 12 is aligned with bore 20, at which point spring plate 14 resiliently springs forward and captures tip 23 of pin 12. Leg assembly 11 is free to move along arrow 9 when the enlarged tapered tip 23 of pin 12 is no longer engaged with bore 20. This is accomplished by depressing tongue 19 of spring plate 14 toward modesty panel 30 a sufficient distance that pin 12 is completely removed from bore 20, as in 19' of FIG. 3.

The latch mechanism receives much of its strength by the inclusion of bracket 13 whose irregular shape serves several functions simultaneously. Bracket 13, which is preferably formed from 11 gauge cold rolled steel, is attached to modesty panel 30 in any conventional manner, such as by screws 15 as shown in FIG. 4. In the case of a metallic modesty panel, both spring plate 14 and bracket 13 could be attached by welding. Bracket 13 includes a backstop surface 26 which engages the groove 24 of pin 12 to prevent leg assembly 11 from pivoting beyond the point where pin 12 aligns with bore 20 of spring plate 14. This feature adds lateral support to the table employing the latch mechanism by preventing any significant movement of leg assembly 11 toward or away from modesty panel 30. Backstop 26 also forms the vertex of a V-shaped notch 16 which guides pin 12 to align with bore 20 of spring plate 14. In one specific embodiment, V-shaped notch 16 subtends an angle of approximately 75°. This feature, along with the taper of tip 23 of pin 12 helps to relax the assembly tolerances for the complete table without sacrificing the performance of the latch mechanism. The uniform taper of tip 23 also permits wear between pin 12 and bore 20 without any significant loss in performance.

In order to ensure that bracket 13 does not deform after repeated use, the ends of the bracket are welded back onto each other at weld locations 27. Another important feature of bracket 13 is that it is preferably cut and sized to produce an elongated channel 28 having a width that is only slightly wider than spring plate 14. In this way, spring plate 14 is received within the elongated channel 28 when both components are attached to modesty panel 30 without significantly interfering with the cantilever action of spring plate 14. This feature helps to prevent shear stress on screws 21 which are used for attaching end 17 of spring plate 14 to modesty panel 30.

Pin 12, and therefore table leg 11, can be released from the latched position by depressing tongue 19 of cantilever beam 14 toward side panel 10 as shown in 19' of FIG. 3. When bore 20 is no longer engaging pin 12, leg assembly 11 is free to pivot back along arrow 9 to its folded position for storage. This feature of the present invention is shown in phantom in both FIGS. 2 and 4. FIG. 2 shows leg assembly 31' approximately halfway between its stowed position and its upright position, while FIG. 4 shows a portion of leg assembly 11' in a similar configuration.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A latch mechanism for a folding table that includes stowable legs, a modesty panel and a horizontal table top supported by the legs, the latch mechanism latching the legs of the table into an upright position, the latch mechanism comprising:

a pin having a base and a tip, said base being rigidly fastened to a leg of the table such that said tip projects away from said leg;

a spring plate defining a bore sized to receive at least a portion of said tip of said pin therethrough, said spring plate being attached to said modesty panel such that said pin aligns with said bore when the table leg is opened to its upright position;

a bracket attached to said modesty panel, said bracket defining a backstop surface positioned adjacent said bore of said spring plate to contact said pin when said pin is aligned with said bore;

means for resiliently biasing said spring plate away from said modesty panel and against said pin when the table leg is in its upright position to continuously urge said pin against said backstop; and whereby said pin is freed from said bore allowing said legs of the table to move to their stowed position when said spring plate is moved toward said modesty panel against the action of said means for resiliently biasing.

2. The latch mechanism of claim 1 wherein said spring plate is cantilevered and has first and second ends, said first end being attached to said modesty panel and said second end being free; and said means for resiliently biasing includes a bend in said plate between said first end and second end.

3. The latch mechanism of claim 2 further comprising means for guiding said pin to align with said bore when said leg is moved from its stowed position to its upright position.

4. The latch mechanism of claim 3 wherein said means for guiding includes said bracket attached to said modesty panel, said bracket including a V-shaped notch positioned to engage said pin when said pin is approaching said bore.

5. The latch mechanism of claim 4 wherein said backstop surface is at the vertex of said V-shaped notch.

6. The latch mechanism of claim 5 wherein said pin includes a groove that receives a portion of said V-shaped notch therein when said pin is aligned with said bore.

7. The latch mechanism of claim 6 wherein said tip of said pin is tapered.

8. The latch mechanism of claim 7 wherein said plate has a cantilevered length defined by the distance between said bend and said bore, said cantilevered length being sufficiently long that said spring plate makes substantially horizontal contact with said pin.

9. A folding table comprising:

a horizontal table top;

four legs each having one end pivotally attached to said table top and being movable between a stowed position and an upright position;

a vertical modesty panel attached along one edge of said table top such that two of said four legs are adjacent said modesty panel when said two legs are in said upright position;

a latch mechanism for locking at least one of said two legs in said upright position, said latch mechanism including a pin attached to one of either a leg or said modesty panel and a spring plate attached to the other of said leg or said modesty panel;

said spring plate having an edge biased to an outward position away from said other of said leg or said modesty panel but being depressible from said outward position;

said pin having a tapered tip that engages said edge of said spring plate when said leg is in said upright position; and wherein said edge of said spring plate is continuously resiliently urged toward said outward position against the tapered tip of said pin when said leg is in said upright position.

10. The folding table of claim 9 wherein said pin is attached to said leg and said spring plate is attached to said modesty panel.

11. The folding table of claim 10 further comprising a backstop attached to said modesty panel and positioned to contact said pin when said leg is in said upright position such that said edge of said spring plate resiliently urges said pin against said backstop.

12. The folding table of claim 11 wherein:

said modesty panel is pivotable to a stowed configuration;

said pin includes a groove; and said backstop is a portion of a bracket attached to said modesty panel, said bracket includes a rim that is received in said groove when said leg is in said upright position such that said modesty panel is unable to pivot toward said stowed configuration.

13. The folding table of claim 9 wherein said edge is a portion of an annular edge that defines a bore in said spring plate, and said tapered tip is at least partially received in said bore when said leg is in said upright position.

14. A latch mechanism for a folding table having stowable legs, a modesty panel and a horizontal table top supported by the legs, the latch mechanism latching a leg of the table into an upright position, the latch mechanism comprising:

an elongated spring plate with one end attached to the modesty panel and an opposite other end resiliently biased away from the modesty panel toward the leg when the leg is in its upright position, said spring plate including an edge located adjacent said other end;

a pin having a tip and being rigidly fastened to a leg of the table such that said tip projects away from the leg, said tip engaging said edge of said spring plate when the leg is in its upright position; and a bracket attached to said modesty panel, said bracket including a backstop surface positioned to contact said pin when said leg is in said upright position such that said pin is engaged between said backstop surface and said edge of said spring plate, when said edge of said spring plate is continuously resiliently urged against said pin when the leg is in its upright position.

15. The latch mechanism of claim 14 wherein:

said spring plate has a width at said other end; and said bracket defines a channel slightly wider than said width to receive said other end therein when said bracket is attached to the modesty panel about said spring plate, said other end of said spring plate being confined by said bracket to movement in and out of said channel.

16. The latch mechanism of claim 15 wherein said pin includes a groove and said bracket includes a rim that is received in said groove when said leg is in said upright position such that the modesty panel is unable to move with respect to the leg.

17. The folding table of claim 14 wherein said edge is a portion of an annular edge that defines a bore in said spring plate, and said pin has a tapered tip that is at least partially received in said bore when said leg is in said upright position.

* * * * *